US007824719B2

(12) United States Patent
Cole et al.

(10) Patent No.: US 7,824,719 B2
(45) Date of Patent: Nov. 2, 2010

(54) COOKING PACKAGE

(75) Inventors: Lorin R. Cole, Larsen, WI (US); Eric Krablean, Plymouth, WI (US)

(73) Assignee: Graphic Packaging International, Inc., Marietta, GA (US)

( * ) Notice: Subject to any disclaimer, the term of this patent is extended or adjusted under 35 U.S.C. 154(b) by 461 days.

(21) Appl. No.: 11/751,235

(22) Filed: May 21, 2007

(65) Prior Publication Data

US 2007/0275130 A1 Nov. 29, 2007

Related U.S. Application Data

(60) Provisional application No. 60/801,968, filed on May 19, 2006.

(51) Int. Cl.
*B65D 81/34* (2006.01)
*H05B 6/80* (2006.01)

(52) U.S. Cl. ..... 426/107; 426/106; 426/113; 426/114; 219/730; 229/120.18

(58) Field of Classification Search ..... 426/106.107, 426/113, 114; 219/678, 730; 229/103.11, 229/120.18
See application file for complete search history.

(56) References Cited

U.S. PATENT DOCUMENTS

| | | | | |
|---|---|---|---|---|
| 3,515,331 | A * | 6/1970 | Guthrie, Sr. | 229/103.11 |
| 4,775,771 | A | 10/1988 | Pawlowski et al. | |
| 4,865,921 | A | 9/1989 | Hollenberg et al. | |
| 4,890,439 | A | 1/1990 | Smart et al. | |
| 4,936,935 | A | 6/1990 | Beckett | |
| 4,963,424 | A | 10/1990 | Beckett | |
| 5,039,364 | A | 8/1991 | Beckett et al. | |
| 5,049,710 | A * | 9/1991 | Prosise et al. | 219/730 |
| 5,117,078 | A | 5/1992 | Beckett | |
| 5,213,902 | A | 5/1993 | Beckett | |
| 5,221,419 | A | 6/1993 | Beckett | |
| 5,260,537 | A | 11/1993 | Beckett | |
| 5,266,386 | A | 11/1993 | Beckett | |
| RE34,683 | E | 8/1994 | Maynard et al. | |
| 5,338,921 | A | 8/1994 | Maheux et al. | |
| 5,340,436 | A | 8/1994 | Beckett | |
| 5,354,973 | A | 10/1994 | Beckett | |
| 5,410,135 | A | 4/1995 | Pollart et al. | |
| 5,424,517 | A | 6/1995 | Habeger, Jr. et al. | |
| 5,519,195 | A | 5/1996 | Keefer et al. | |
| 5,628,921 | A | 5/1997 | Beckett | |
| 5,672,407 | A | 9/1997 | Beckett | |
| 5,726,426 | A * | 3/1998 | Davis | 219/730 |

(Continued)

FOREIGN PATENT DOCUMENTS

| | | |
|---|---|---|
| EP | 0 270 838 | 6/1988 |

(Continued)

*Primary Examiner*—Rena L Dye
*Assistant Examiner*—Saeeda Latham
(74) *Attorney, Agent, or Firm*—Womble Carlyle Sandridge & Rice, PLLC

(57) ABSTRACT

A package for heating a food product. The package has a tray with a central panel for supporting the food product and a flexible flap containing a layer of microwave insulating material for heating the food product. The flexible flap has independently movable sections, wraps around the food product, and forms an open ended cooking sleeve.

18 Claims, 13 Drawing Sheets

U.S. PATENT DOCUMENTS

| | | | |
|---|---|---|---|
| 5,759,422 | A | 6/1998 | Schmelzer et al. |
| 5,800,724 | A | 9/1998 | Habeger et al. |
| 6,114,679 | A | 9/2000 | Lai et al. |
| 6,150,646 | A | 11/2000 | Lai et al. |
| 6,204,492 | B1 | 3/2001 | Zeng et al. |
| 6,251,451 | B1 | 6/2001 | Zeng |
| 6,414,290 | B1 | 7/2002 | Cole et al. |
| 6,433,322 | B2 | 8/2002 | Zeng et al. |
| 6,455,827 | B2 | 9/2002 | Zeng |
| 6,552,315 | B2 | 4/2003 | Zeng et al. |
| 6,677,563 | B2 | 1/2004 | Lai |
| 6,717,121 | B2 | 4/2004 | Zeng et al. |
| 6,765,182 | B2 | 7/2004 | Cole et al. |
| 7,019,271 | B2 | 3/2006 | Wnek et al. |
| 7,365,292 | B2 | 4/2008 | Cole et al. |
| 7,514,659 | B2 | 4/2009 | Lafferty |
| 2006/0049190 | A1 | 3/2006 | Middleton |
| 2006/0113300 | A1 | 6/2006 | Wnek |
| 2006/0278521 | A1 | 12/2006 | Stowell |
| 2007/0251942 | A1 | 11/2007 | Cole et al. |
| 2007/0251943 | A1 | 11/2007 | Wnek et al. |
| 2007/0275130 | A1 | 11/2007 | Cole et al. |
| 2008/0000897 | A1 | 1/2008 | Robbins et al. |
| 2008/0047958 | A1 | 2/2008 | Cole et al. |
| 2008/0078759 | A1 | 4/2008 | Wnek et al. |
| 2008/0081095 | A1 | 4/2008 | Cole et al. |
| 2009/0090708 | A1 | 4/2009 | Requena et al. |

FOREIGN PATENT DOCUMENTS

| | | | | |
|---|---|---|---|---|
| EP | 0270838 | | * | 6/1988 |
| EP | 1 481 922 | A2 | | 12/2004 |
| EP | 1481922 | A2 | * | 12/2004 |
| FR | 2 867 346 | | | 9/2005 |
| JP | 4-253670 | | | 9/1992 |
| WO | WO 94/05563 | | | 3/1994 |
| WO | WO 03/066435 | A2 | | 8/2003 |
| WO | WO 2005/077783 | A1 | | 8/2005 |
| WO | WO 2006/076501 | A1 | | 7/2006 |
| WO | WO 2007/127235 | A2 | | 11/2007 |
| WO | WO 2007/133659 | A2 | | 11/2007 |
| WO | WO 2007/136839 | A2 | | 11/2007 |

* cited by examiner

COOKING PACKAGE

CROSS-REFERENCE TO RELATED APPLICATION

This application claims the benefit of U.S. Provisional Application No. 60/801,968 which was filed on May 19, 2006. The entire content of the above-referenced provisional application is hereby incorporated by reference as if presented herein in its entirety.

BACKGROUND OF THE INVENTION

The present invention relates to the field of food preparation, and in particular, relates to materials and constructs that may be used to prepare foods in a microwave oven.

Microwave ovens commonly are used to cook food in a rapid and effective manner. To optimize the cooking performance of microwave ovens, various food packaging arrangements have been developed to block, enhance, direct, and otherwise affect microwave interaction with food.

If browning or crisping of the exterior of the food item is desired, the food item is placed in a container that includes a susceptor. The susceptor typically includes a microwave energy interactive material, such as a metal, that absorbs, reflects, and transmits microwave energy in varying proportions. The surface to be browned is placed proximate the susceptor. The susceptor absorbs the microwave energy and thereby becomes hot, and transmits heat to the food item to promote surface browning and crisping. Further, some of the microwave energy is typically transmitted to the inside of the food item.

Numerous susceptor configurations, shapes, and sizes are known in the art. Depending on the susceptor arrangement, the time of exposure to microwave energy, the desired degree of browning and crisping, and other factors, the susceptor may be in intimate or proximate contact with the food item. Thus, a material or package including a susceptor may be used to cook a food item, and to brown or crisp the surface of the food item in a way similar to conventional frying, baking, or grilling.

One particular food packaging arrangement that may employ susceptors involves closed cells formed between layers of packaging material. Upon exposure to microwave energy, the cells expand to form inflated cells that thermally insulate the food item in the package from the environment exterior to the package. One example of a microwave packaging material that provides inflatable cells is described in co-pending published PCT application PCT/US03/03779 titled "Insulating Microwave Interactive Packaging", the entire disclosure of which is hereby incorporated by reference herein.

Despite prior advances, numerous challenges in microwave cooking remain. For example, many existing packages are fixed in shape and do not provide cooking surfaces that are positioned sufficiently close to the food item to brown or crisp the surface of the food item. Thus, there remains a need for improved microwave energy interactive packages.

SUMMARY OF THE INVENTION

In general, one aspect of the invention is generally directed to a package for heating a food product in a microwave oven. The package comprises a tray for holding the food product and a flexible cover for at least partially covering the tray and the food product. The cover comprises a microwave interactive material.

In another aspect, the invention is generally directed to a package for a food product having a shape. The package comprises a tray for holding the food product and a flexible cover at least partially covering the tray and the food product. The flexible cover comprises a plurality of fold lines that are substantially parallel to one another so that the flexible cover is adapted for at least partially conforming to the shape of the food product.

In another aspect, the invention is generally directed to a blank for forming a package for holding and heating a food product. The blank comprises a plurality of tray panels comprising a central panel and a plurality of side panels foldably attached to the central panel for being positioned relative to the central panel to form a tray when the blank is formed into the package. A flexible flap is foldably attached to at least one of the central panel and the plurality of panels. The flexible flap has a plurality of fold lines that are substantially parallel to one another so that the flexible flap has a plurality of independently moveable sections respectively at least partially defined by fold lines of the plurality of fold lines. The plurality of fold lines includes at least three fold lines, and the plurality of independently moveable sections includes at least three independently moveable sections.

In another aspect, the invention is generally directed to a combination of a tray blank, for forming a tray, and a cover blank, for forming a cover for at least partially covering the tray. The tray blank comprising a central panel and a plurality of side panels foldably attached to the central panel. The cover blank comprises spaced apart lateral fold lines and independently moveable sections of the blank that are at least partially defined by the lateral fold lines.

In another aspect, the invention is generally directed to a method of preparing a food product. The method comprises providing a package comprising a tray and a flexible cover. A food product is placed in the tray and at least partially covered with the cover. The at least partially covering the food product includes bending the cover so that the cover at least partially conforms to the shape of the food product. The method further comprises heating the food product in a microwave oven.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the invention.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present invention relates generally to various aspects of materials and packages for cooking food items, and methods of making such materials and packages. Although several different inventions, aspects, implementations, and embodiments of the various inventions are provided, numerous interrelationships between, combinations thereof, and modifications of the various inventions, aspects, implementations, and embodiments of the inventions are contemplated hereby.

Figure 1:
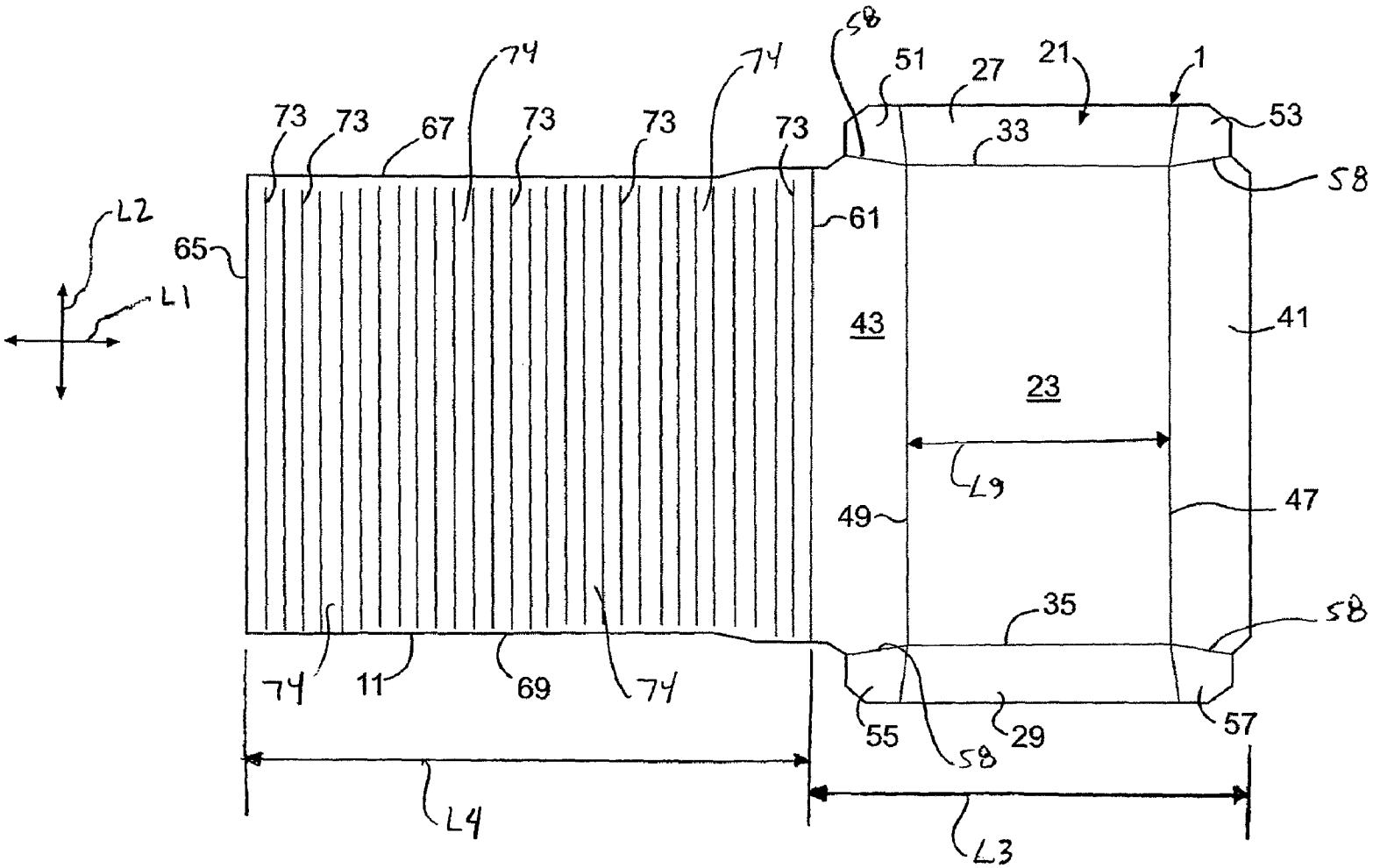
FIG. 1 is a plan view of a blank used to form a package according to a first embodiment of the present invention.

FIG. 1 is a plan view of a blank, generally indicated at 1, used to form a package 3 (FIGS. 2-4) of a first embodiment of the invention. The package 3 is used to hold a food product P (FIG. 9A), such as a sandwich, calzone, turnover, burrito, or any other food product, during cooking of the food product. In one example, the package 3 with food product P is placed in a microwave oven (not shown) to heat and/or cook the food product. In the illustrated embodiment, the package 3 includes a tray 7 that is sized to hold the food product and a flexible flap 11 (broadly "flexible cover") foldably attached to the tray that at least partially wraps around the food product. The flexible flap 11 and/or a portion of the tray 7 may have an element for use in cooking, heating, browning, and/or shielding (e.g., a microwave energy interactive element 15 such as, but not limited to, a susceptor) mounted thereto. It is understood that the microwave energy interactive element 15 (FIG. 2) may be omitted from the package 3.

The blank 1 has a longitudinal axis L1 and a lateral axis L2. The blank 1 includes a bottom panel 21 that forms the tray 7 of the package. The bottom panel 21 includes a central panel 23, and first and second panels 27, 29 at respective lateral ends of the central panel. The side panels 27, 29 are respectively foldably connected to the central panel 23 at respective longitudinal fold lines 33, 35. Third and fourth side panels 41, 43 are foldably connected to the central panel 23 at respective longitudinal ends of the central panel. The side panels 41, 43 are foldably connected to the central panel 23 at respective lateral fold lines 47, 49. In the illustrated embodiment, the bottom panel 21 includes two corner panels 51, 53 foldably attached to the first side panel 27 along respective lateral fold lines 49, 47, and two corner panels 55, 57 foldably attached to the second side panel 29 along the respective lateral fold lines 49, 47. The corner panels 51, 53 55, 57 are respectively separated from the side panels 41, 43 by slits 58 or the like. The side panels 27, 29, 41, 43 and corner panels 51, 53, 55, 57 are each foldable relative to the central panel 23 so that the bottom panel 21 forms the 7 tray that contains the food product in the package 3 assembled from the blank 1. Differently configured bottom panels 21 and trays 7 are also within the scope of the present invention.

In the illustrated embodiment, the flexible flap 11 is foldably connected to the side panel 43 at a first lateral fold line 61. The flexible flap 11 extends from the side panel 43 and has a longitudinal edge 65 and two spaced apart lateral edges 67, 69. As shown in FIG. 1, the flexible flap 11 is generally rectangular and has twenty-nine spaced apart fold lines 73 that extend in the lateral direction across the flap. Only a representative few of the fold lines 72 are identified by their reference numbers in FIG. 1. The fold lines 73 may be cut lines, scores, or any other lines of weakening in the flap 11. In the illustrated embodiment, the fold lines 73 are spaced evenly across the length of the flap 11 between the fold line 61 and the longitudinal edge 65. The flexible flap 11 has independently moveable sections 74 between the fold lines 73. In one embodiment, the adjacent fold lines 73 are spaced apart approximately ¼ inch (6 mm) but it is understood that the fold lines may have other spacing. The flexible flap 11 has a width approximately equal to the width of the central panel 23; however, the flap may be otherwise shaped and dimensioned without departing from the scope of this invention.

In the illustrated embodiment, the flexible flap 11 is made of the same generally rigid material (e.g., paperboard) as the tray 7 and is made flexible by the fold lines 73. The independently moveable sections 74 between the fold lines 73 allow the flap 11 to flex and conform to the shape of the food product P. It is understood that the flexible flap 11 could comprise other materials (e.g., thin films or webs) that may be flexible without fold lines 73.

In the embodiment of FIG. 1, the bottom panel 21 has a width L3 in the longitudinal direction L1 of the blank 1, the flexible flap 11 has a length L4 in the longitudinal direction of the blank, and the central panel 23 has a width L9 in the longitudinal direction of the blank. In the illustrated embodiment, the length L4 of the flexible flap 11 is greater than the width L3 of the bottom panel 21. In one particular embodiment the length L4 is approximately 7½ inches (190 mm), the width L3 is approximately 5½ inches (140 mm), and the width L9 is approximately 3½ inches (89 mm). All dimensional information presented herein is intended to be illustrative of exemplary embodiments and is not intended to limit the scope of the invention.

In the illustrated embodiment, the microwave interactive element 15 (FIG. 2) covers, at least in part, the interior surfaces of the flexible flap 11, the second longitudinal end panel 43, and the central panel 23. In one embodiment, the microwave interactive element 15 is a generally rectangular panel that is attached to the blank 1 by adhesive material (not shown) or by an other acceptable mechanism that is proximate the edges of the panel. It is understood that the adhesive attaching the microwave interactive 15 to the blank 1 may be a patterned layer of adhesive such as evenly spaced spots of adhesive or the adhesive could be otherwise applied without departing from the scope of this invention. The perimeter bonding of the microwave interactive element 15 to the blank 1 may allow the material of the microwave interactive element to more easily expand when heated to more effectively brown or crisp the food product in the package 3.

The material of the microwave interactive element 15 can be, or include, any type of known microwave interactive material, such as a susceptor that is for absorbing microwaves and/or converting microwaves into thermal energy to thereby become hot and to at least radiantly provide heat to food, a microwave energy shielding element that is for reflecting microwaves away from at least a portion of a food item, a microwave energy directing element for directing microwaves toward at least a portion of a food item, and various combinations of these and other features. In accordance with exemplary embodiments of the present invention, the material of the microwave interactive element 15 can more specifically be a microwave insulating material (discussed in detail below) in contact with the food product for heating, browning, and/or crisping the food product during operation of the microwave oven. It is understood that the food product may be a type of food product that may or may not require browning or crisping during microwave heating without departing from the scope of this invention.

According to various aspects of the present invention, the material of the microwave interactive element 15 of the present invention could be any arrangement of layers, such as polymer (e.g., polyester) film layers, susceptor or "microwave interactive" layers, paper layers, continuous and discontinuous adhesive layers, and patterned adhesive layers, that provides an insulating effect. The material of the microwave interactive element 15 may include one or more susceptors, one or more expandable insulating cells, or a combination of susceptors and expandable insulating cells. Examples of materials that may be suitable, alone or in combination, include, but are not limited to, QWIKWAVE brand susceptor, QWIKWAVE FOCUS brand susceptor, MICRO-RITE brand susceptor, MICROFLEX Q brand susceptor, and QUILTWAVE brand susceptor, each of which is commercially available from Graphic Packaging International, Inc. The material may be any suitable expandable cell material as desired, and, in some instances, may include any of the materials described herein, any of the materials described in PCT Application PCT/US03/03779, which is entirely incorporated by reference herein, or any combination thereof. Alternatively and as should be apparent from the foregoing, as one example the microwave interactive element 15 can consist essentially solely of a susceptor.

An exemplary material of the microwave interactive element 15 is depicted in FIGS. 5-8. In each of the examples shown herein, it should be understood that the layer widths are not necessarily shown in perspective. In some instances, for example, the adhesive layers are very thin with respect to other layers, but are nonetheless shown with some thickness for purposes of clearly illustrating the arrangement of layers.

Figure 5:
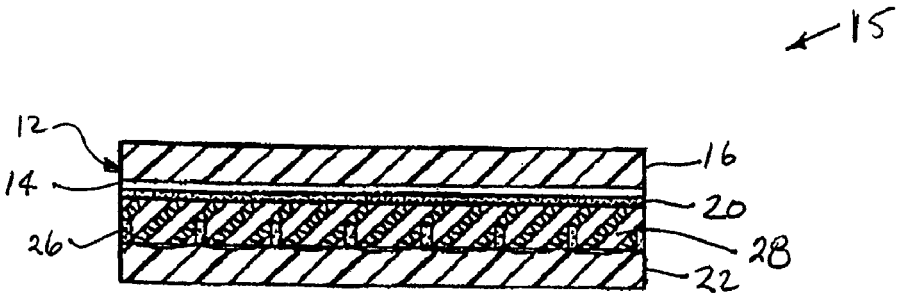
FIG. 5 is a schematic cross-sectional view of an insulating microwave material that may be used in accordance with the present invention.

Referring to FIG. 5, the material of the microwave interactive element 15 may be a combination of several different material layers. A susceptor 12, which typically includes a thin layer of microwave interactive material 14 on a first plastic film 16, is bonded, for example by lamination with an adhesive (not shown), to a dimensionally stable substrate 20, for example, paper. The substrate 20 is bonded to a second plastic film 22 using a patterned adhesive 26 or other material, such that closed cells 28 are typically formed in the material of the microwave interactive element 15. The closed cells 28 are substantially resistant to vapor migration.

Figure 8:
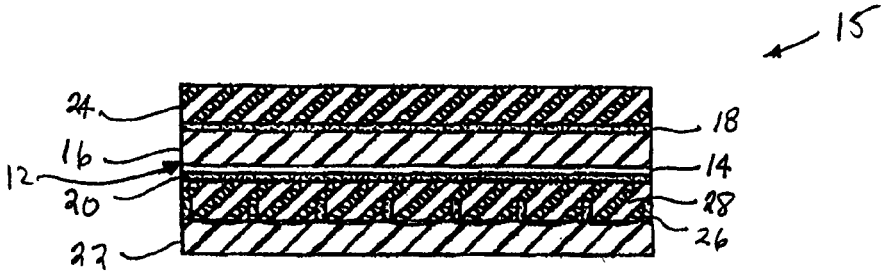
FIG. 8 is a schematic cross-sectional view of an alternative insulating microwave material that may be used in accordance with the present invention.

Optionally, an additional substrate layer 24 may be adhered by adhesive or otherwise to the first plastic film 16 opposite the microwave interactive element material, as depicted in FIG. 8. The additional substrate layer 24 may be a layer of paper or any other suitable material, and may be provided to shield the food item (not shown) from any flakes of susceptor film that craze and peel away from the substrate during heating. The material for the microwave interactive element 15 is a substantially flat, multi-layered sheet, as shown in FIG. 6.

Figure 6:
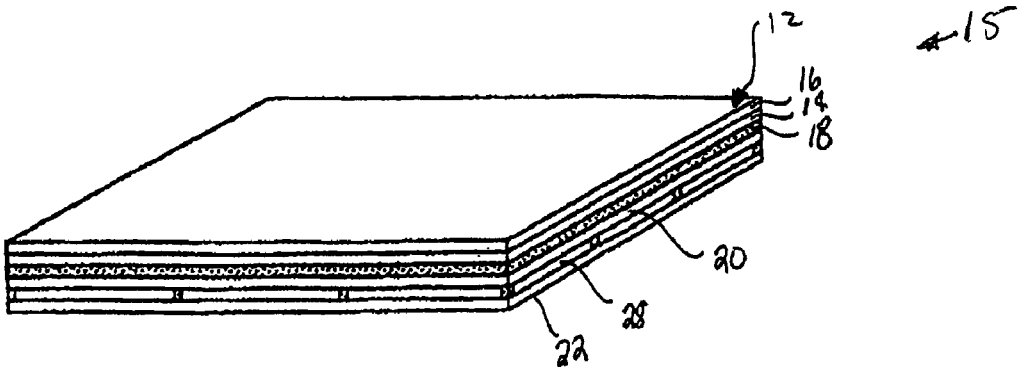
FIG. 6 is a schematic perspective view of the insulating microwave material of FIG. 5.
Figure 7:
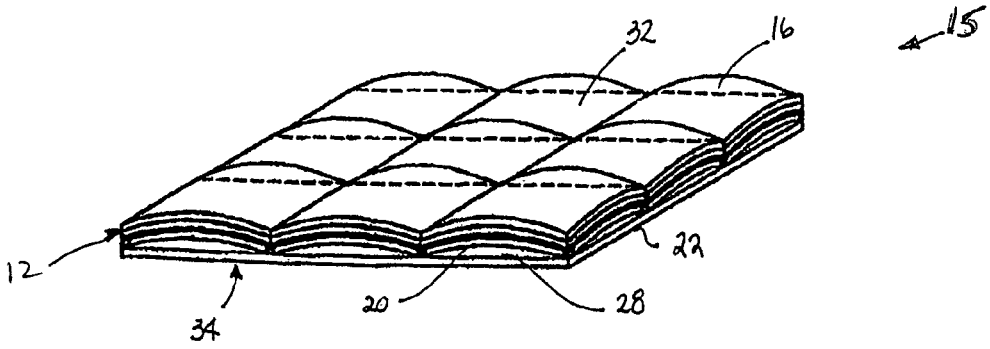
FIG. 7 is a schematic perspective view of the insulating microwave material of FIG. 5 after exposure to microwave energy.

FIG. 7 depicts the exemplary material of the microwave interactive element 15 of FIGS. 5 and 6 subjected to microwave energy from a microwave oven (not shown).

As the susceptor 12 heats upon impingement by microwave energy, water vapor and other gases normally held in the substrate 20, and any air trapped in the thin space between the second plastic film 22 and the substrate 20 in the closed cells 28, expand. The expansion of water vapor and air (or any other suitable material) in the closed cells 28 applies pressure on the susceptor 12 and the substrate 20 on one side and the second plastic film 22 on the other side of the closed cells 28. Each side of the material 15 forming the closed cells 28 reacts simultaneously, but uniquely, to the heating and vapor expansion. The cells 28 expand or inflate to form a quilted top surface 32 of "pillows" separated by channels (not shown) in the susceptor 12 and substrate 20 lamination, which lofts above a bottom surface 34 formed by the second plastic film 22. This expansion may occur within 1 to 15 seconds in an energized microwave oven, and in some instances, may occur within 2 to 10 seconds.

The expansion of the cells 28 allows the microwave insulating material 15 to conform more closely to the surface of the food item, placing the susceptor 12 in greater proximity to the food item. This enhances the ability of the microwave insulating material 15 to brown and crisp the surface of the food item by conduction heating, in addition to some convection heating, of the food item. It is understood that the microwave insulating material 15 used in the package 3 of the present invention may include other materials than described herein and may be otherwise arranged, configured, and designed, without departing from the scope of this invention. Further, multiple layers of microwave insulating material 15 may be used in the package 3.

Figure 2:
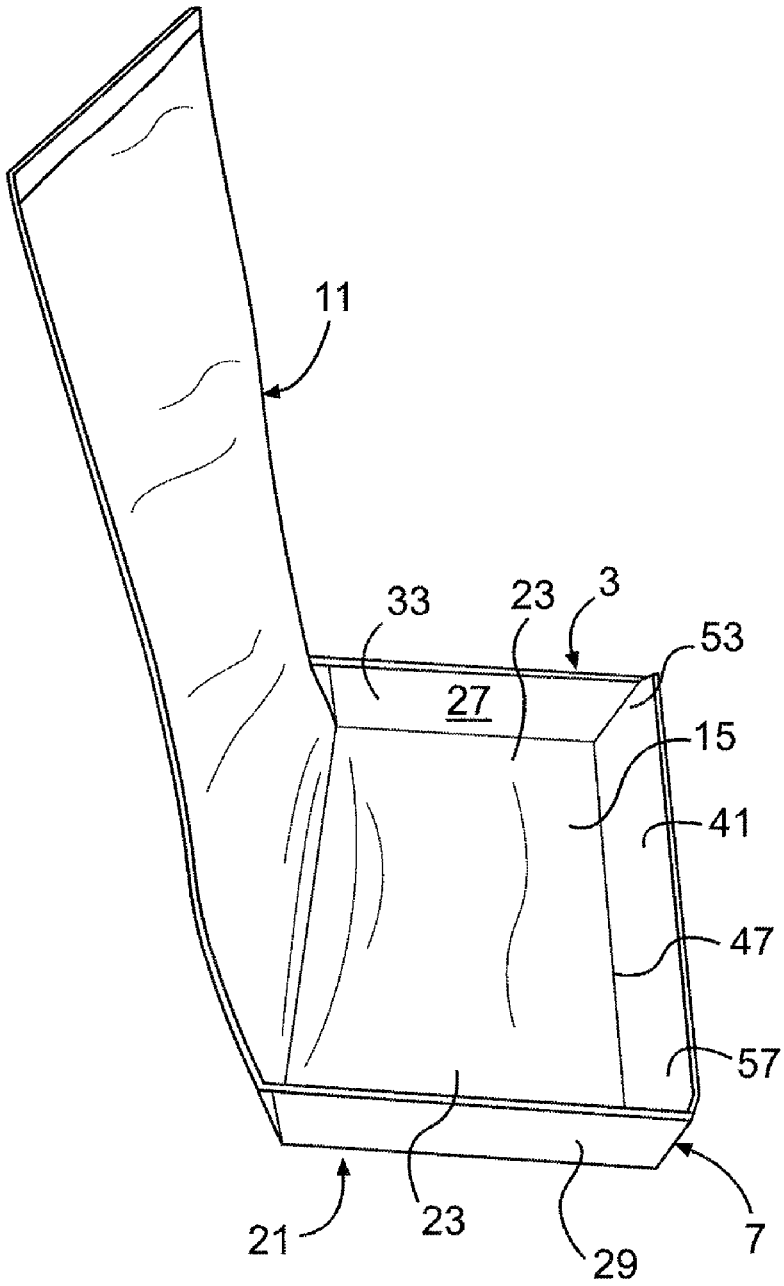
FIG. 2 is a perspective of the package in a partially assembled configuration.
Figure 3:
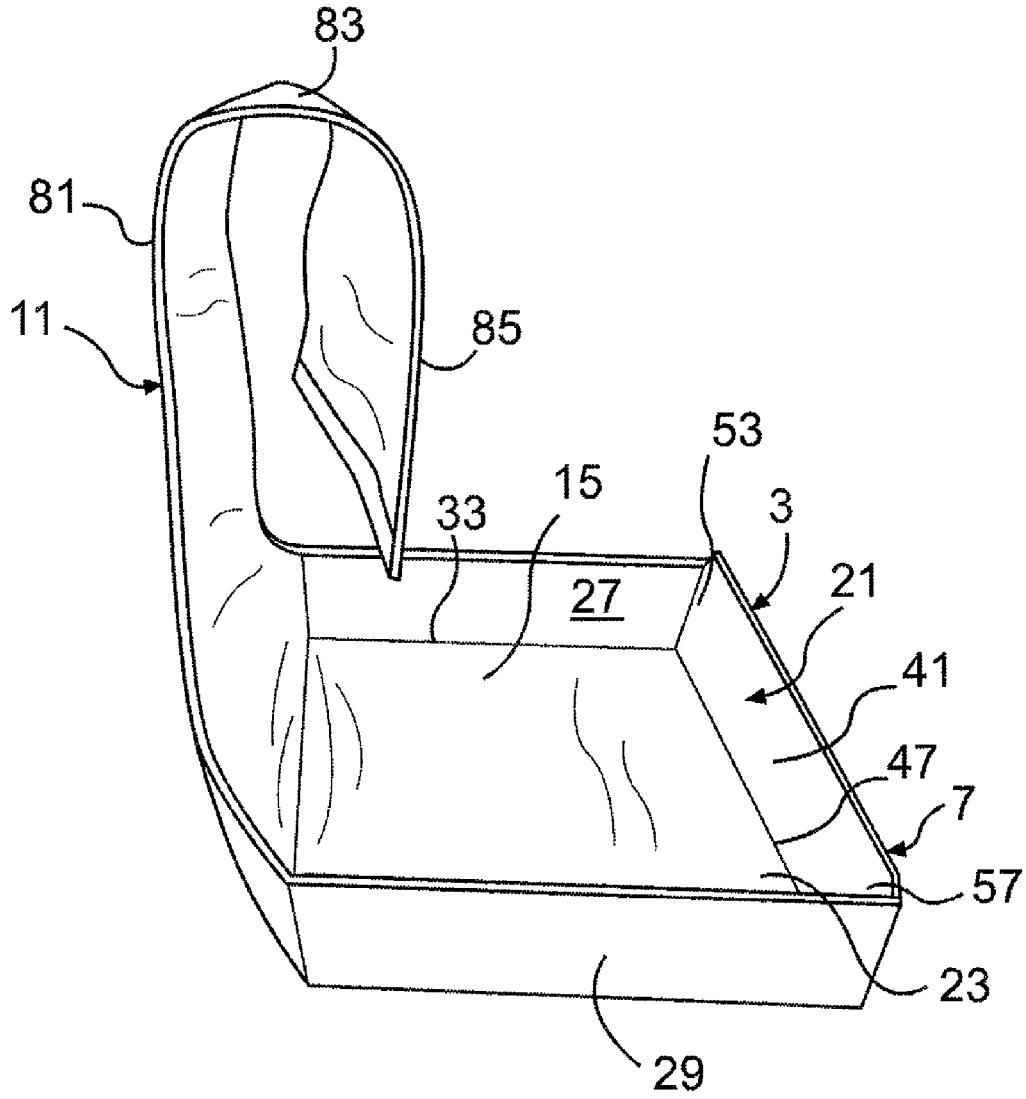
FIG. 3 is a perspective of the package further assembled.
Figure 4:
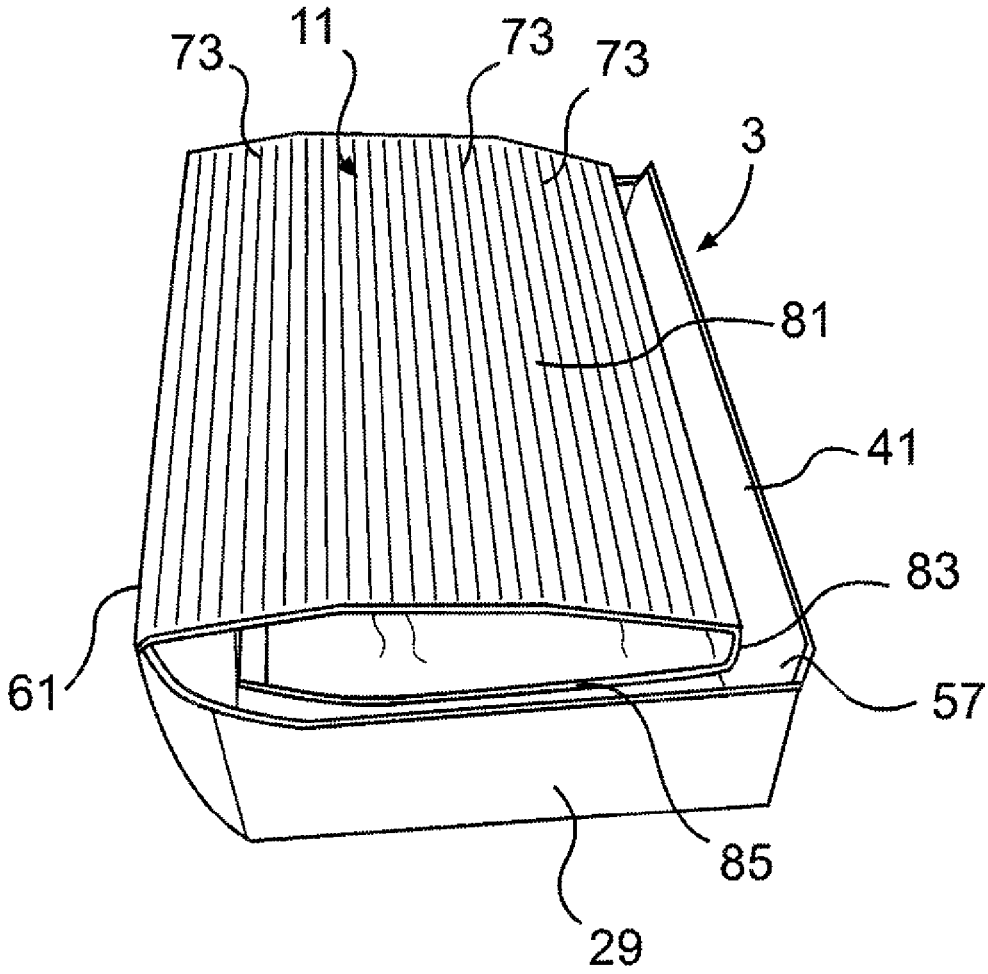
FIG. 4 is a perspective of the package assembled for heating a food product in accordance with one example of the first embodiment.

As shown in FIGS. 2-4 and described in the following in accordance with one acceptable example, the package 3 is formed from the blank by first upwardly folding the side panels 27, 29, 41, 43 and folding the corner panels 51, 53, 55, 57 of the bottom panel 21 relative to the central panel 23 to form the tray 7 having upwardly extending side walls that contain the food product P. Each of the corner panels 51, 53, 55, 57 may be folded perpendicular to a respective side panel 27, 29 and placed in a generally face-to-face relationship with a respective side panel 41, 43. The corner panels 51, 53, 55, 57 may be attached to one of the respective side panels 41, 43 by adhesive. Next, the flexible flap 11 is folded upward along the lateral fold line 61 to the position shown in FIG. 2. As shown in FIG. 3, the flexible flap 11 is formed into a generally C-shaped wrap for placement around a food product. The C-shaped flexible flap 11 is placed around the food product P and folded downward to the position of FIG. 4. The flexible flap 11 wraps around the food product P and includes a generally flat upper layer 81 extending from the side panel 43 of the bottom panel 21, a curved portion 83, and a generally flat bottom layer 85 that wraps around the bottom of the food product. It is understood that the food product P may be placed in the C-shaped flexible flap 11 as the flap is being folded downward to cover the tray 7 or the food product may be first placed on the central panel 23 of the tray with the flexible flap being shaped around and covering the food product. It is understood that the flexible flap 11 of the illustrated embodiment is positioned around the food product P to form an open ended cooking sleeve that includes the microwave insulating material 15 wrapped around and covering the food product. The plurality of lateral fold lines 73 give the flexible flap 11 the required flexibility to allow the flap, and the microwave insulating material attached thereto, to conform closely to the surface of the food product which may be irregular in shape.

Prior to cooking, some of the microwave insulating material 15 may not be in intimate contact with an irregularly shaped food product wrapped in the flexible flap 11. As such, only some portions of the food product will be in direct contact with the susceptor material 12. As noted above for one version of the first embodiment, the expansion of the cells 28 of the microwave insulting material 15 causes the susceptor 12 to bulge against the food product, providing increased contact with the surface of the food product, and thus more efficient heating, browning, and/or crisping thereof.

Figure 9:
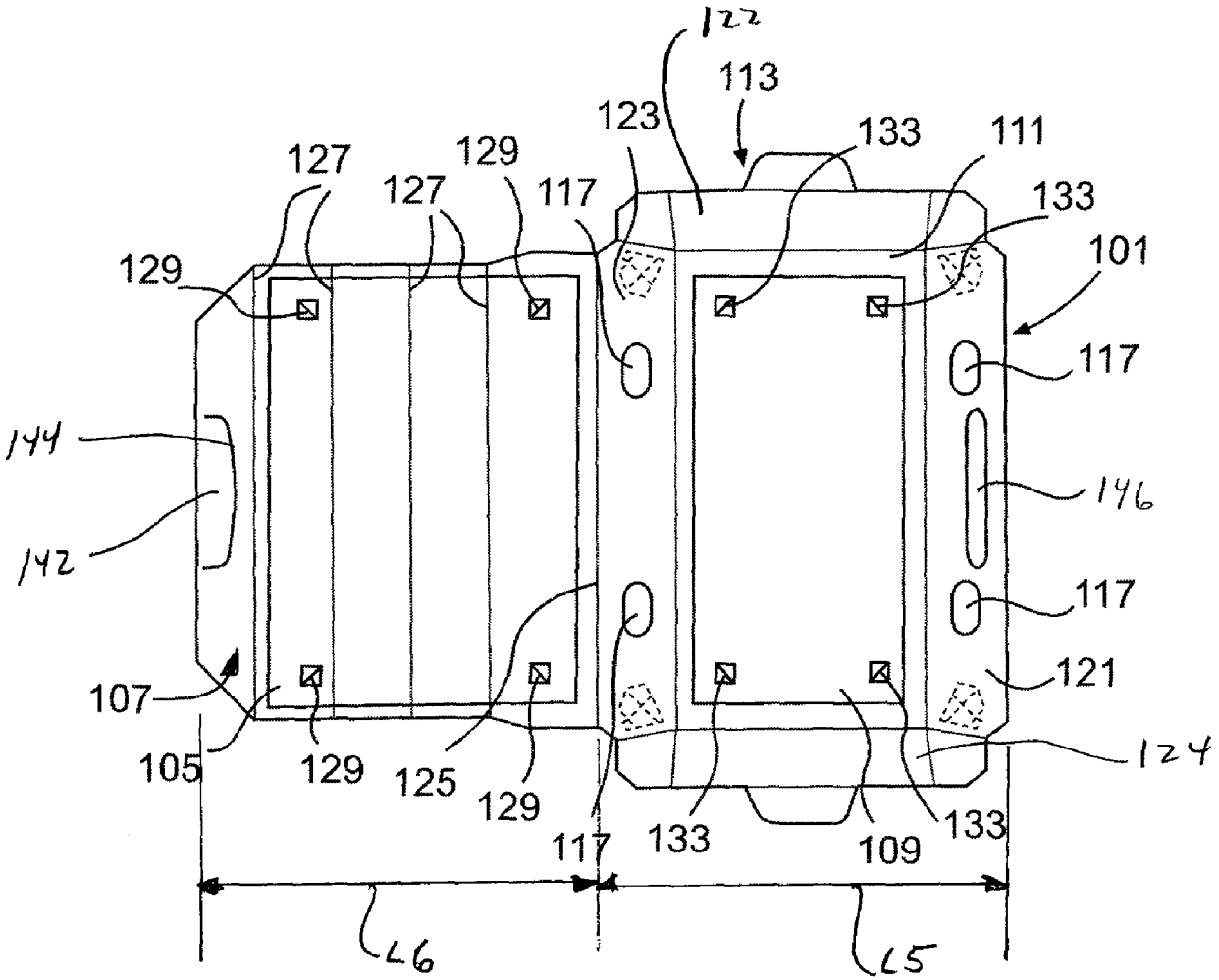
FIG. 9 is a plan view of a blank used to form a package of a second embodiment of the present invention.

FIG. 9 shows a second embodiment of the present invention in the form of a blank 101 used to form a package 103 (FIG. 9A) for heating food products P in a similar manner as the first embodiment. The package 103 is similar to the package 3 of the first embodiment except that the blank 101 includes a first microwave energy interactive element 105 attached to the flexible flap 107 (broadly "cover") and a second microwave energy interactive element 109 attached to the central panel 111. Also, the flexible flap 107 is shorter than the flap 11 of the first embodiment so that the flexible flap 107 covers the tray 108 of the second embodiment without wrapping the food product P.

The tray 108 is formed from a bottom panel 113 of the blank 101 that is similar to the bottom panel 21 of the first embodiment in that it has a central panel 111 and four side panels 121, 122, 123, 124. The bottom panel 113 has ventilation holes 117 in the side panels 121, 123. The flexible flap 107 is attached to the side panel 123 at lateral fold line 125 and has four spaced apart lateral fold lines 127 extending between the lateral edges of the flap. The first microwave interactive element 105 is attached to the flexible flap 107 by adhesive 129 (schematically shown) at four locations generally adjacent a respective corner of the first microwave interactive element. The second microwave interactive element 109 is attached to the central panel 111 of the bottom panel 113 by adhesive 133 (schematically shown) at four locations generally adjacent a respective corner of the second microwave interactive element. As shown in FIG. 9, the first microwave interactive element 105 and second microwave interactive element 109 are both rectangular, but the elements may be otherwise shaped (e.g., square, irregular-shaped, etc.) without departing from the scope of this invention. The microwave interactive elements 105, 109 of this embodiment may comprise a microwave interactive material similar to or the same as the material described above for the first embodiment, or the microwave interactive elements may be otherwise configured without departing from the scope of this invention. Further, the microwave interactive elements 105, 109 may comprise multiple layers of microwave insulating material.

Figure 9A:
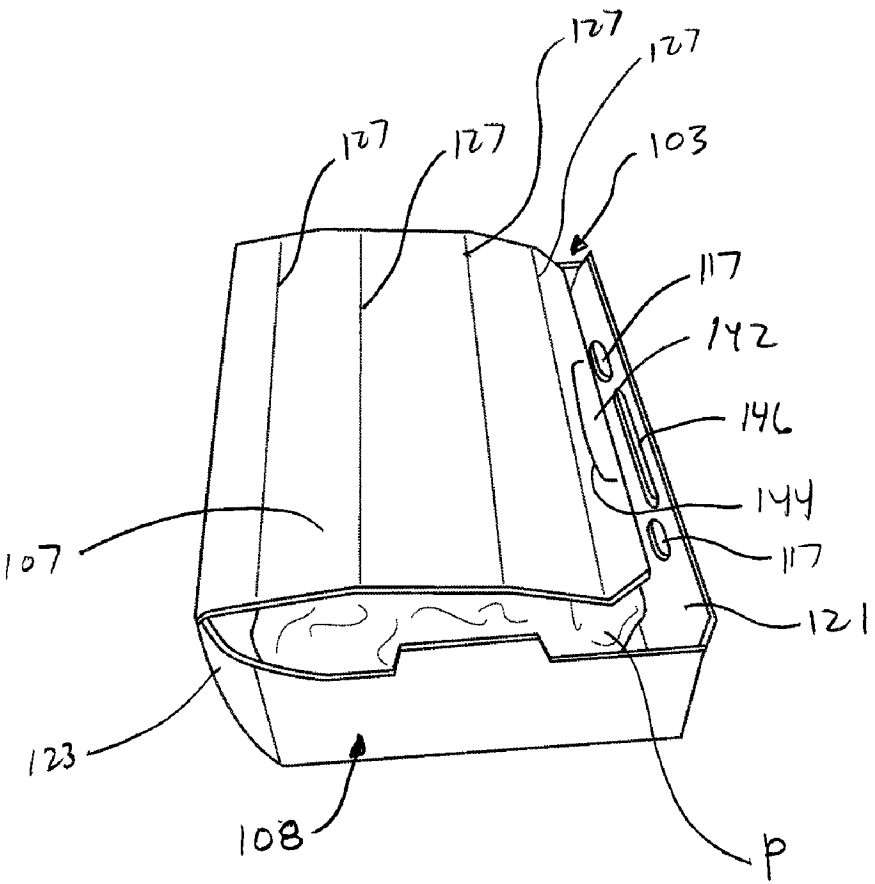
FIG. 9A is a perspective of the package of the second embodiment.

In using the package 103 of the second embodiment in accordance with one acceptable method described in the following, the tray 108 is first formed from the bottom panel 113 and the food product P is placed in the tray in contact with the second microwave insulating panel 109. The food product P is enclosed by covering the tray 108 formed from the bottom panel 113 with the flexible flap 107 by folding the flexible flap along lateral fold line 125. The flexible flap 107 may be secured to the side panel 121 of the bottom panel 113 by various attachment means. For example in the illustrated embodiment, the flexible flap 107 has a locking tab 142 formed by a cut line 144 that is sized for being received in a locking recess 146 in the side panel 121 of the tray to retain the flexible flap in the closed position of FIG. 9A. The tab 142 can be outwardly folded from the position shown in FIG. 9A and inserted into the locking recess 146 to hold the flexible flap 107 in the closed position. When the flexible flap 107 is closed as shown in FIG. 9A, the first microwave interactive element 105 is positioned in contact with or in a close proximate relationship with the top surface of the food product P. As with the previous embodiment, the first and second microwave interactive elements 105, 109 of the package browns and crisps the food product P when the package 103 is heated in a microwave oven.

In the embodiment of FIG. 9, the bottom panel 113 has a width L5 in the longitudinal direction of the blank 101 and the flexible flap 107 has a width L6 in the longitudinal direction of the blank. In the illustrated embodiment, the width L6 of the flexible flap 107 is approximately equal to the width L5 of the bottom panel 113. In one particular embodiment the width L5 and the width L6 are approximately 5¼ inches (133 mm). All dimensional information presented herein is intended to be illustrative of exemplary embodiments and is not intended to limit the scope of the invention.

Figure 10:
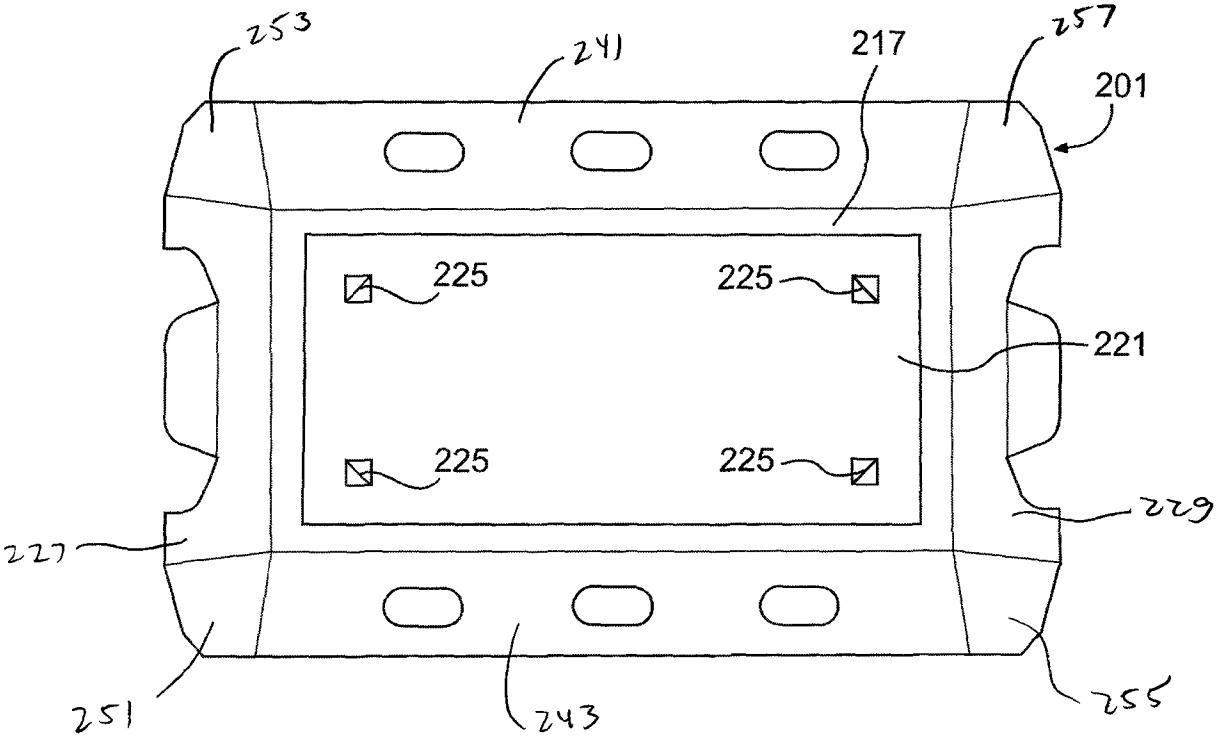
FIG. 10 is a plan view of a tray blank used to form a package of a third embodiment of the present invention.
Figure 11:
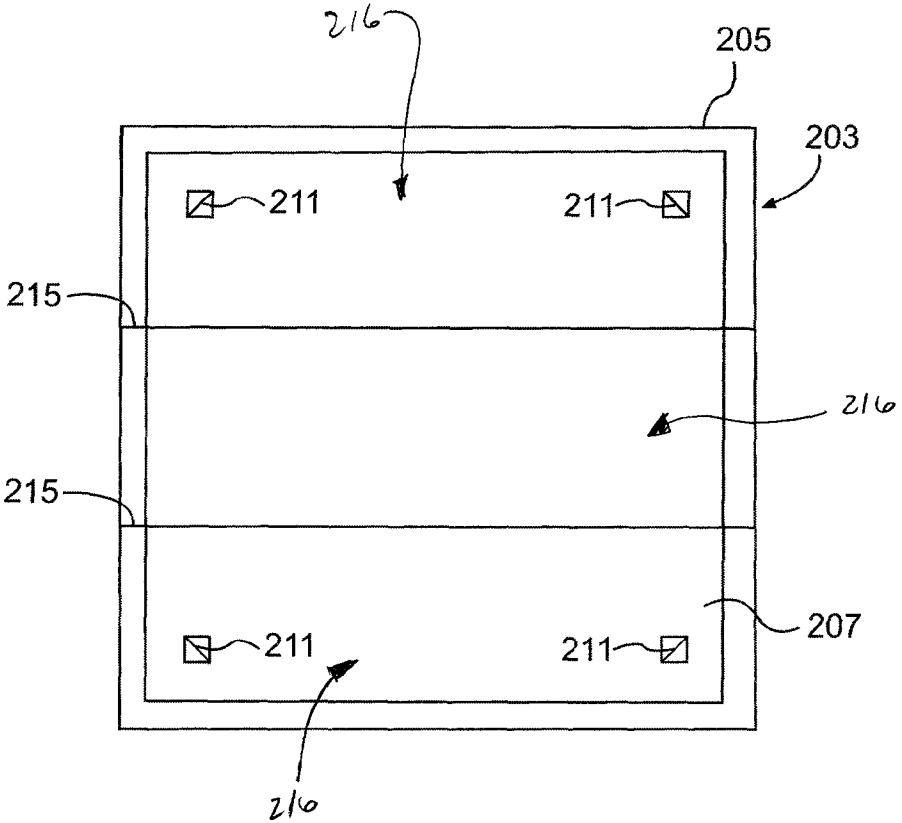
FIG. 11 is a plan view of a lid blank used to form a package of the third embodiment.
Figure 11A:
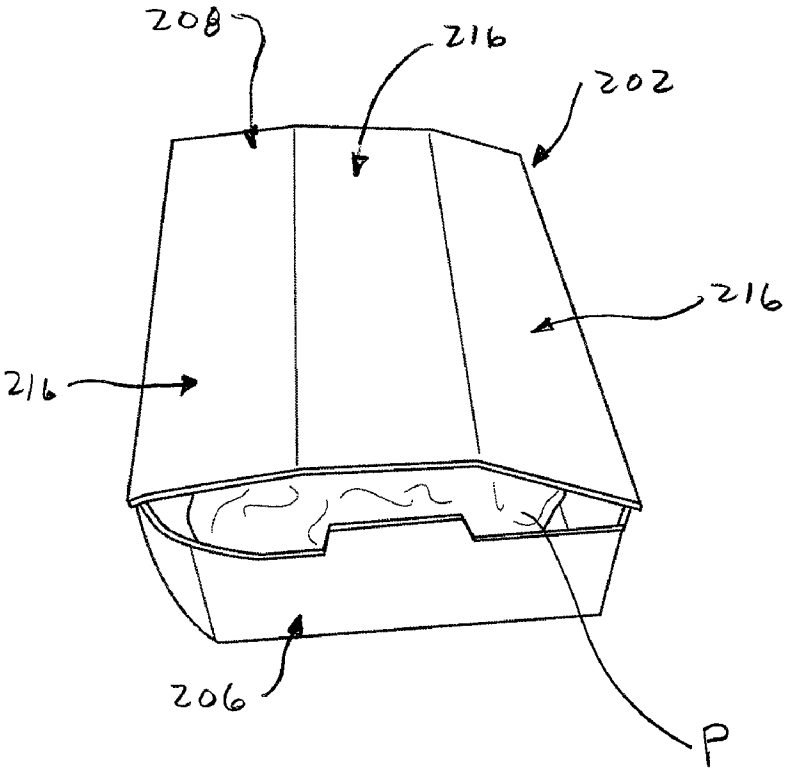
FIG. 11A is a perspective of the package of the third embodiment.

FIGS. 10-11A show a third embodiment of a package 202 (FIG. 1A) of the present invention. The package 202 is similar to the previous embodiment except that the tray 206 is formed from a tray blank 201 (FIG. 10) and the cover 208 is formed from a cover blank 203 (FIG. 11). The tray and cover blanks 201, 203 cooperate to form the package 202 for heating the food product in a similar manner as the previous embodiments.

As best understood with reference to FIG. 11, the cover blank 203 includes a generally rectangular panel 205 with the first microwave insulating panel 207 attached thereto by adhesive 211 (schematically shown) located generally adjacent the respective corners of the panel. The cover blank 203 includes two spaced apart fold lines 215 extending between the lateral edges of the panel and three independently moveable sections 216 defined by the fold lines.

As best understood with reference to FIG. 10, the tray blank 201 includes a generally rectangular central panel 217 with the second microwave insulating panel 221 attached thereto by adhesive 225 (schematically shown) located generally adjacent the respective corners of the central panel. As with the previous embodiments, the tray blank 201 includes side panels 227, 229, 241, 243 and corner panels 251, 253, 255, 257 for positioning relative to the central panel 217 when forming the tray 206.

It is understood that the package 202 of this embodiment may be assembled by first forming the food-holding tray 206 from the tray blank 201 in a similar manner as the previous embodiments. Food product P is placed on the central panel 217 of the tray 206 in contact with the microwave interactive element 221. The tray 206 is covered by forming the cover blank 203 into the cover 208 by folding along fold lines 215 to position the panels 216 as generally shown in FIG. 11A. The cover 208 is placed on top of the tray 206 so that the first microwave insulating panel 207 is positioned in contact with or in close proximate relation to the top of the food product P. The food product P may be heated in a similar manner as discussed above so that the first and second microwave interactive elements 207, 221 brown, crisp, heat, and/or cook the food product. It is understood that the cover 208 and the tray 206 could be used separately to heat a single side of the food product P without departing from the scope of this invention. As with the previous embodiments, the first and second microwave interactive elements 207, 221 may comprise one or more layers of microwave insulating material.

Figure 12:
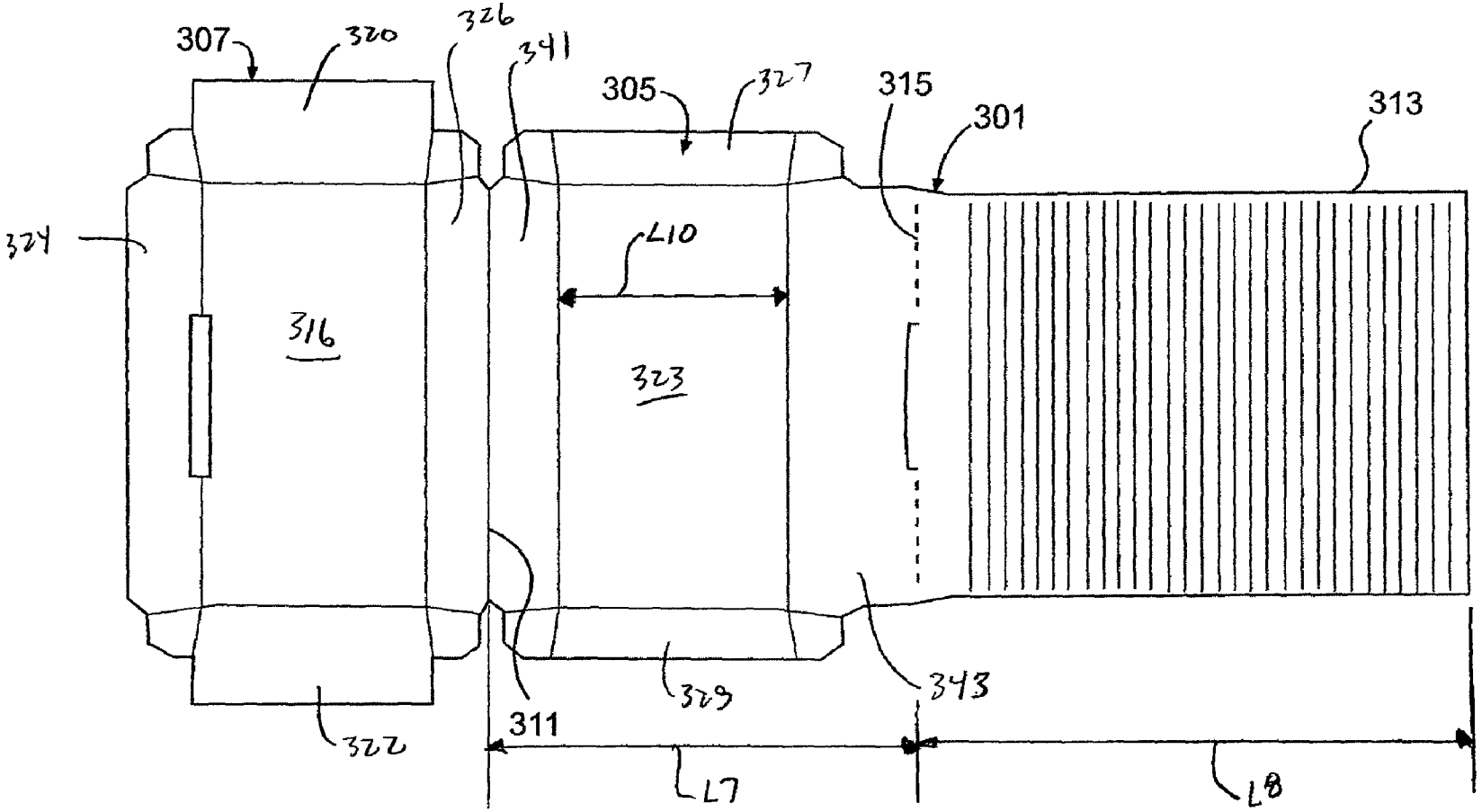
FIG. 12 is a plan view of a blank used to form a package of a fourth embodiment of the present invention.
Figure 12A:
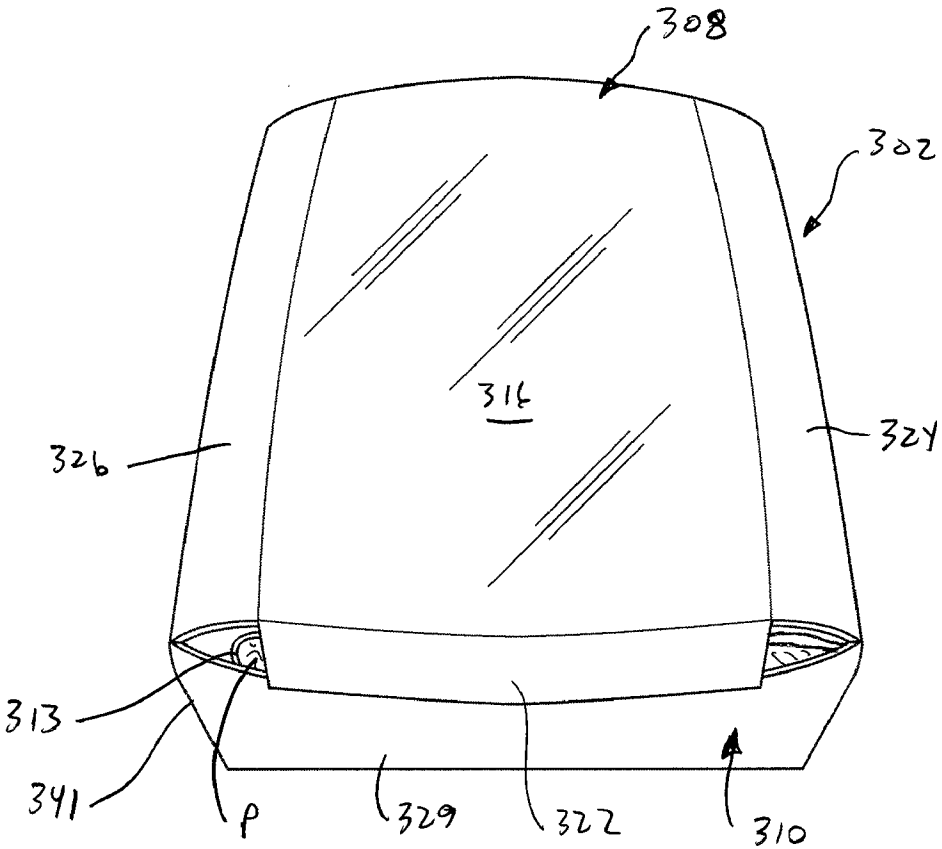
FIG. 12A is a perspective of the package of the fourth embodiment.

FIG. 12 shows a fourth embodiment of a blank 301 used to form a package 302 of the present invention. The blank 301 includes bottom panel 305 similar to the bottom panel 21 of the first embodiment, a top panel 307 foldably attached to the bottom panel along a lateral fold line 311, and a flexible flap 313 that is like the flexible flap 11 of the first embodiment and is attached to the bottom panel along a lateral fold line 315. The bottom panel 305 includes a central panel 323 and four side panels 327, 329, 341, 343 foldably attached to the central panel for forming the bottom panel into a tray. In the illustrated embodiment, the top panel 307 includes a central panel 316 and four side panels 320, 322, 324, 326 foldably attached to the central panel. The central panel 316 and side panels 320, 322, 326 of the top panel 307 form a lid 308 and the central panel 323 and four side panels 327, 329 341, 343 form a tray 310. The lid 308 is foldably attached to the tray 310 at the fold line 311. The lid 308 cooperates with the tray 310 to close the package 302 of the fourth embodiment.

As with the first embodiment a microwave insulating layer (not shown) may be attached to at least a portion of the interior surface of the flexible flap 313 and bottom panel 305. In this embodiment, the blank 301 is formed into the package 302 for heating the food product P in a similar manner as the blank 1 of the first embodiment except that the lid 308 formed by the top panel 307 is folded about lateral fold line 311 to cover the food product that is wrapped by the flexible flap 313. The lid 308 and the tray 310 formed from the top and bottom panels 307, 305 cooperate to fully enclose the food product P during heating. The use of the lid 308 formed by top panel 307 to enclose the food product P during heating provides an additional layer of insulation that provides additional heating of the food product preventing the heat generated, such as by the microwave insulating layer, from escaping from the top or sides of the package 302. As with the previous embodiments, the microwave insulating layer may include one or more layers of microwave insulating material without departing from the scope of this invention.

In the embodiment of FIG. 12, the bottom panel 305 has a width L7 in the longitudinal direction L1 of the blank 301, the flexible flap 313 has a length L8 in the longitudinal direction of the blank, and the central panel 323 has a width L10 in the longitudinal direction of the blank. In the illustrated embodiment, the length L8 of the flexible flap 313 is greater than the width L7 of the bottom panel 305. In one particular embodiment the width L7 is approximately 6½ inches (165 mm) and the length L8 is approximately 10 inches (254 mm) and the width L10 is approximately 3½ inches (89 mm).All dimensional information presented herein is intended to be illustrative of exemplary embodiments and is not intended to limit the scope of the invention.

For convenience, food items and packages are described herein as having a top, bottom, and sides. In many instances, the top, bottom, and sides of a package or a food item are relative to a surface the food item is placed on and the perspective of the viewer. It should be understood that reference to a top, bottom, or side is not meant to impart any particular limitation on the scope of the invention, but merely provide an easy way to refer to describe the features thereof.

Various microwave energy interactive elements may be suitable for use with the invention. For example, the microwave energy interactive elements may promote browning and/or crisping of a particular area of the food item, shield a particular area of the food item from microwave energy to prevent overcooking thereof, or transmit microwave energy towards or away from a particular area of the food item. Each microwave interactive element comprises one or more microwave energy interactive materials or segments arranged in a particular configuration to absorb microwave energy, transmit microwave energy, reflect microwave energy, or direct microwave energy, as needed or desired for a particular construct and food item.

The microwave interactive element may be supported on a microwave inactive or transparent substrate for ease of handling and/or to prevent contact between the microwave interactive material and the food item. As a matter of convenience and not limitation, and although it is understood that a microwave interactive element supported on a microwave transparent substrate includes both microwave interactive and microwave inactive elements or components, such constructs are referred to herein as "microwave interactive webs".

The microwave energy interactive material may be an electroconductive or semiconductive material, for example, a metal or a metal alloy provided as a metal foil; a vacuum deposited metal or metal alloy; or a metallic ink, an organic ink, an inorganic ink, a metallic paste, an organic paste, an inorganic paste, or any combination thereof. Examples of metals and metal alloys that may be suitable for use with the present invention include, but are not limited to, aluminum, chromium, copper, inconel alloys (nickel-chromium-molybdenum alloy with niobium), iron, magnesium, nickel, stainless steel, tin, titanium, tungsten, and any combination or alloy thereof.

Alternatively, the microwave energy interactive material may comprise a metal oxide. Examples of metal oxides that may be suitable for use with the present invention include, but are not limited to, oxides of aluminum, iron, and tin, used in conjunction with an electrically conductive material where needed. Another example of a metal oxide that may be suitable for use with the present invention is indium tin oxide (ITO). ITO can be used as a microwave energy interactive material to provide a heating effect, a shielding effect, a browning and/or crisping effect, or a combination thereof. For example, to form a susceptor, ITO may be sputtered onto a clear polymeric film. The sputtering process typically occurs at a lower temperature than the evaporative deposition process used for metal deposition. ITO has a more uniform crystal structure and, therefore, is clear at most coating thicknesses. Additionally, ITO can be used for either heating or field management effects. ITO also may have fewer defects than metals, thereby making thick coatings of ITO more suitable for field management than thick coatings of metals, such as aluminum.

Alternatively, the microwave energy interactive material may comprise a suitable electroconductive, semiconductive, or non-conductive artificial dielectric or ferroelectric. Artificial dielectrics comprise conductive, subdivided material in a polymeric or other suitable matrix or binder, and may include flakes of an electroconductive metal, for example, aluminum.

In one example, the microwave interactive element may comprise a thin layer of microwave interactive material that tends to absorb microwave energy, thereby generating heat at the interface with a food item. Such elements often are used to promote browning and/or crisping of the surface of a food item (sometimes referred to as a "browning and/or crisping element"). When supported on a film or other substrate, such an element may be referred to as a "susceptor film" or, simply, "susceptor". However, other microwave energy interactive elements, such as those described herein, are contemplated hereby.

As another example, the microwave interactive element may comprise a foil having a thickness sufficient to shield one or more selected portions of the food item from microwave energy (sometimes referred to as a "shielding element"). Such shielding elements may be used where the food item is prone to scorching or drying out during heating.

The shielding element may be formed from various materials and may have various configurations, depending on the particular application for which the shielding element is used. Typically, the shielding element is formed from a conductive, reflective metal or metal alloy, for example, aluminum, copper, or stainless steel. The shielding element generally may have a thickness of from about 0.000285 inches to about 0.05 inches. In one aspect, the shielding element has a thickness of from about 0.0003 inches to about 0.03 inches. In another aspect, the shielding element has a thickness of from about 0.00035 inches to about 0.020 inches, for example, 0.016 inches.

As still another example, the microwave interactive element may comprise a segmented foil, such as, but not limited to, those described in U.S. Pat. Nos. 6,204,492, 6,433,322, 6,552,315, and 6,677,563, each of which is incorporated by reference in its entirety. Although segmented foils are not continuous, appropriately spaced groupings of such segments often act as a transmitting element to direct microwave energy to specific areas of the food item. Such foils also may be used in combination with browning and/or crisping elements, for example, susceptors.

Any of the numerous microwave interactive elements described herein or contemplated hereby may be substantially continuous, that is, without substantial breaks or interruptions, or may be discontinuous, for example, by including one or more breaks or apertures that transmit microwave energy therethrough. The breaks or apertures may be sized and positioned to heat particular areas of the food item selectively. The number, shape, size, and positioning of such breaks or apertures may vary for a particular application depending on type of construct being formed, the food item to be heated therein or thereon, the desired degree of shielding, browning, and/or crisping, whether direct exposure to microwave energy is needed or desired to attain uniform heating of the food item, the need for regulating the change in temperature of the food item through direct heating, and whether and to what extent there is a need for venting.

It will be understood that the aperture may be a physical aperture or void in the material used to form the construct, or may be a non-physical "aperture". A non-physical aperture may be a portion of the construct that is microwave energy inactive by deactivation or otherwise, or one that is otherwise transparent to microwave energy. Thus, for example, the aperture may be a portion of the construct formed without a microwave energy active material or, alternatively, may be a portion of the construct formed with a microwave energy active material that has been deactivated. While both physical and non-physical apertures allow the food item to be heated directly by the microwave energy, a physical aperture also provides a venting function to allow steam or other vapors to be released from the food item. It also may be beneficial to create one or more discontinuities or inactive regions to prevent overheating or charring of the carton.

As stated above, any of the above elements and numerous others contemplated hereby may be supported on a substrate. The substrate typically comprises for example, a polymer film or other polymeric material. As used herein the term "polymer" or "polymeric material" includes, but is not limited to, homopolymers, copolymers, such as for example, block, graft, random, and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic, and random symmetries.

The thickness of the film typically may be from about 35 gauge to about 10 mil. In one aspect, the thickness of the film is from about 40 to about 80 gauge. In another aspect, the thickness of the film is from about 45 to about 50 gauge. In still another aspect, the thickness of the film is about 48 gauge. Examples of polymeric films that may be suitable include, but are not limited to, polyolefins, polyesters, polyamides, polyimides, polysulfones, polyether ketones, cellophanes, or any combination thereof. Other non-conducting substrate materials such as paper and paper laminates, metal oxides, silicates, cellulosics, or any combination thereof, also may be used.

In one example, the polymeric film comprises polyethylene terephthalate (PET). Polyethylene terephthalate films are used in commercially available susceptors, for example, the QWIKWAVE® susceptor and the MICRORITE® susceptor laminations, both available from Graphic Packaging International (Marietta, Ga.). Examples of polyethylene terephthalate films that may be suitable for use as the substrate include, but are not limited to, MELINEX® films, commercially available from DuPont Teijan Films (Hopewell, Va.), SKYROL films, commercially available from SKC, Inc. (Covington, Ga.), and BARRIALOX PET films, available from Toray Films (Front Royal, Va.), and QU50 High Barrier Coated PET films, available from Toray Films (Front Royal, Va.).

The polymeric film may be selected to impart various properties to the paper or paperboard web, for example, printability, heat resistance, or any other property. As one particular example, the polymeric film may be selected to provide a water barrier, oxygen barrier, or a combination thereof. Such barrier film layers may be formed from a polymer film having barrier properties or from any other barrier layer or coating as desired. Suitable polymer films may include, but are not limited to, ethylene vinyl alcohol, barrier nylon, polyvinylidene chloride, barrier fluoropolymer, nylon 6, nylon 6,6, coextruded nylon 6/EVOH/nylon 6, silicon oxide coated film, barrier polyethylene terephthalate, or any combination thereof.

One example of a barrier film that may be suitable for use with the present invention is CAPRAN® EMBLEM 1200M nylon 6 film, commercially available from Honeywell International (Pottsville, Pa.). Another example of a barrier film that may be suitable is CAPRAN® OXYSHIELD OBS monoaxially oriented coextruded nylon 6/ethylene vinyl alcohol (EVOH)/nylon 6 film, also commercially available from Honeywell International. Yet another example of a barrier film that may be suitable for use with the present invention is DARTEK® N-201 nylon 6,6 film, commercially available from Enhance Packaging Technologies (Webster, N.Y.). Additional examples include BARRIALOX PET film, available from Toray Films (Front Royal, Va.) and QU50 High Barrier Coated PET film, available from Toray Films (Front Royal, Va.), referred to above.

Still other barrier films include silicon oxide coated films, such as those available from Sheldahl Films (Northfield, Minn.). Thus, in one example, a susceptor may have a structure including a film, for example, polyethylene terephthalate, with a layer of silicon oxide coated onto the film, and ITO or other material deposited over the silicon oxide. If needed or desired, additional layers or coatings may be provided to shield the individual layers from damage during processing.

The barrier film may have an oxygen transmission rate (OTR) as measured using ASTM D3985 of less than about 20 cc/m2/day. In one aspect, the barrier film has an OTR of less than about 10 cc/m2/day. In another aspect, the barrier film has an OTR of less than about 1 cc/m2/day. In still another aspect, the barrier film has an OTR of less than about 0.5 cc/m2/day. In yet another aspect, the barrier film has an OTR of less than about 0.1 cc/m2/day.

The barrier film may have a water vapor transmission rate (WVTR) of less than about 100 g/m2/day as measured using ASTM F1249. In one aspect, the barrier film has a water vapor transmission rate of less than about 50 g/m2/day. In another aspect, the barrier film has a WVTR of less than about 15 g/m2/day. In yet another aspect, the barrier film has a WVTR of less than about 1 g/m2/day. In still another aspect, the barrier film has a WVTR of less than about 0.1 g/m2/day. In a still further aspect, the barrier film has a WVTR of less than about 0.05 g/m2/day.

Other non-conducting substrate materials such as metal oxides, silicates, cellulosics, or any combination thereof, also may be used in accordance with the present invention.

The microwave energy interactive material may be applied to the substrate in any suitable manner, and in some instances, the microwave energy interactive material is printed on, extruded onto, sputtered onto, evaporated on, or laminated to the substrate. The microwave energy interactive material may be applied to the substrate in any pattern, and using any technique, to achieve the desired heating effect of the food item.

The microwave interactive element or microwave interactive web may be joined to or overlie a dimensionally stable, microwave energy transparent support (hereinafter referred to as "microwave transparent support", "microwave inactive support" or "support") to form the construct. In another aspect, where a more flexible construct is to be formed, the support may comprise a paper or paper-based material generally having a basis weight of from about 15 to about 60 lbs/ream, for example, from about 20 to about 40 lbs/ream. In one particular example, the paper has a basis weight of about 25 lbs/ream.

Optionally, one or more portions of the various blanks or other constructs described herein or contemplated hereby may be coated with varnish, clay, or other materials, either alone or in combination. For example, the microwave energy interactive material may be provided as a continuous or discontinuous layer or coating including circles, loops, hexagons, islands, squares, rectangles, octagons, and so forth. Examples of various patterns and methods that may be suitable for use with the present invention are provided in U.S. Pat. Nos. 7,019,271; 6,765,182; 6,717,121; 6,677,563; 6,552,315; 6,455,827; 6,433,322; 6,414,290; 6,251,451; 6,204,492; 6,150,646; 6,114,679; 5,800,724; 5,759,422; 5,672,407; 5,628,921; 5,519,195; 5,424,517; 5,410,135; 5,354,973; 5,340,436; 5,266,386; 5,260,537; 5221,419; 5,213,902; 5,117,078; 5,039,364; 4,963,424; 4,936,935; 4,890,439; 4,775,771; 4,865,921; and Re. 34,683, each of which is incorporated by reference herein in its entirety. Although particular examples of patterns of microwave energy interactive material are shown and described herein, it should be understood that other patterns of microwave energy interactive material are contemplated by the present invention.

In one aspect, for example, where a rigid or semi-rigid construct is to be formed, all or a portion of the support may be formed at least partially from a paperboard material, which may be cut into a blank prior to use in the construct. For example, the support may be formed from paperboard having a basis weight of from about 60 to about 330 lbs/ream (i.e., lbs/3,000 $ft^2$), for example, from about 80 to about 140 lbs/ream. The paperboard generally may have a thickness of from about 6 to about 30 mils, for example, from about 12 to about 28 mils. In one particular example, the paperboard has a thickness of about 18 mils and a basis weight of from about 100 lbs/ream to about 300 lbs/ream. Any suitable paperboard may be used, for example, a solid bleached or solid unbleached sulfate board, such as SUS® board, commercially available from Graphic Packaging International.

Furthermore, the blanks or other constructs may be coated with, for example, a moisture and/or oxygen barrier layer, on either or both sides, such as those described above. Any suitable moisture and/or oxygen barrier material may be used in accordance with the present invention. Examples of materials that may be suitable include, but are not limited to, polyvinylidene chloride, ethylene vinyl alcohol, DuPont DARTEK™ nylon 6,6 film, and others referred to above.

Alternatively or additionally, any of the blanks, packages, or other constructs of the present invention may be coated or laminated with other materials to impart other properties, such as absorbency, repellency, opacity, color, printability, stiffness, or cushioning. For example, absorbent susceptors are described in U.S. Provisional Application No. 60/604,637, filed Aug. 25, 2004, and U.S. patent application Ser. No. 11/211,858, to Middleton, et al., titled "Absorbent Microwave Interactive Packaging", filed Aug. 25, 2005, both of which are incorporated herein by reference in their entirety. Additionally, the blanks or other constructs may include graphics or indicia printed thereon.

It will be understood that with some combinations of elements and materials, the microwave interactive element may have a grey or silver color this that is visually distinguishable from the substrate or the support. However, in some instances, it may be desirable to provide a web or construct having a uniform color and/or appearance. Such a web or construct may be more aesthetically pleasing to a consumer, particularly when the consumer is accustomed to packages or containers having certain visual attributes, for example, a solid color, a particular pattern, and so on. Thus, for example, the present invention contemplates using a silver or grey toned adhesive to join the microwave interactive elements to the substrate, using a silver or grey toned substrate to mask the presence of the silver or grey toned microwave interactive element, using a dark toned substrate, for example, a black toned substrate, to conceal the presence of the silver or grey toned microwave interactive element, overprinting the metallized side of the web with a silver or grey toned ink to obscure the color variation, printing the non-metallized side of the web with a silver or grey ink or other concealing color in a suitable pattern or as a solid color layer to mask or conceal the presence of the microwave interactive element, or any other suitable technique or combination thereof.

The blanks according to the present invention can be, for example, formed from coated paperboard and similar materials. For example, the interior and/or exterior sides of the blank can be coated with a clay coating. The clay coating may then be printed over with product, advertising, price coding, and other information or images. The blank may then be coated with a varnish to protect any information printed on the blank. The blank may also be coated with, for example, a moisture barrier layer, on either or both sides of the blank. In accordance with the above-described embodiments, the blank may be constructed of paperboard of a caliper such that it is heavier and more rigid than ordinary paper. The blank can also be constructed of other materials, such as cardboard, hard paper, or any other material having properties suitable for enabling the carton to function at least generally as described herein. The blank can also be laminated or coated with one or more sheet-like materials at selected panels or panel sections.

In accordance with the above-described embodiments of the present invention, a fold line can be any substantially linear, although not necessarily straight, form of weakening that facilitates folding therealong. More specifically, but not for the purpose of narrowing the scope of the present invention, fold lines may include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

The foregoing description of the invention illustrates and describes various embodiments of the present invention. As various changes could be made in the above construction without departing from the scope of the invention, it is intended that all matter contained in the above description or shown in the accompanying drawings shall be interpreted as illustrative and not in a limiting sense. Furthermore, the scope of the present invention covers various modifications, combinations, and alterations, etc., of the above-described embodiments that are within the scope of the claims. Additionally, the disclosure shows and describes only selected embodiments of the invention, but the invention is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the invention without departing from the scope of the invention.

What is claimed is:

1. A package for heating a food product in a microwave oven, the package comprising:

a single food product having a shape;

a tray being formed from a blank of rigid material, the tray comprising a central panel for supporting the food product and two side panels foldably connected to the central panel and positioned relative to the central panel to form the tray, the central panel having a width between the two side panels; and a flexible cover for at least partially covering the tray and the food product and for at least partially conforming to a shape of the food product in the tray, wherein the flexible cover is formed from the blank of rigid material and comprises a flap foldably attached to one of the side panels at a fold line, and a microwave interactive material attached to the flap, the flap is sized to wrap around the food product and form an open ended cooking sleeve, the flap has spaced apart lateral fold lines forming independently moveable sections that form a C-shaped wrap that wraps around the food product and at least partially conforms to the shape of the food product, the C-shaped wrap having a bottom portion in contact with a bottom surface of the food product and is in face-to-face contact with the central panel, the flap has a length from the fold line to a free edge of the flap opposite the fold line, the length of the flap being at least about 50% greater than the width of the central panel.

2. The package of claim 1 wherein the flap is generally rectangular.

3. The package of claim 1 wherein the package further comprises a lid foldably attached to the tray.

4. The package of claim 3 wherein the lid comprises a central panel and a plurality of side panels foldably attached to the central panel of the lid, the lid being for cooperating with the tray to close the package.

5. The package of claim 1 wherein the tray and the flexible cover are made from paperboard material.

6. The package of claim 1 wherein the length of the flap is at least about 100% greater than the width of the central panel.

7. The package of claim 1 wherein the flap comprises a surface in contact with the food product, the surface being free from openings.

8. The package of claim 1 wherein the C-shaped wrap comprises a generally flat upper portion extending from one of the side panels and a curved portion extending between the upper portion and the bottom portion.

9. A package, the package comprising:

a single food product having a shape;

a tray being formed from a blank of rigid material, the tray comprising a central panel for supporting the food product and two side panels foldably connected to the central panel and positioned relative to the central panel to form the tray, the central panel having a width between the two side panels; and a flexible cover at least partially covering the tray and the food product, wherein the flexible cover is formed from the blank of rigid material and comprises a flap foldably attached to one of the side panels at a fold line, the flap has a plurality of fold lines that are substantially parallel to one another so that the flexible cover is adapted for at least partially conforming to the shape of the food product in the tray, the plurality of fold lines comprise spaced apart lateral fold lines forming independently moveable sections that form a C-shaped wrap that wraps around the food product and at least partially conforms to the shape of the food product, the C-shaped wrap having a bottom portion in contact with a bottom surface of the food product and is in face-to-face contact with the central panel, the flap has a length from the fold line to a free edge of the flap opposite the fold line, the length of the flap being at least 50% greater than the width of the central panel.

10. The package of claim 9 wherein the plurality of fold lines comprises at least three fold lines.

11. The package of claim 9 wherein the plurality of fold lines comprises more than ten fold lines.

12. The package of claim 9 wherein the flap is generally rectangular.

13. The package of claim 9 further comprising a microwave interactive element attached to the tray and the flexible cover, wherein the microwave interactive element is continuous over an entire inner surface of the central panel and an entire inner surface of the flexible cover.

14. The package of claim 9 wherein the package further comprises a lid foldably attached to the tray.

15. The package of claim 14 wherein the lid comprises a central panel and a plurality of side panels foldably attached to the central panel, the lid being for cooperating with the tray to close the package.

16. The package of claim 9 wherein the tray and the flexible cover are made from paperboard material.

17. The package of claim 9 wherein the length of the flap is at least about 100% greater than the width of the central panel.

18. The package of claim 9 wherein the flap comprises a surface in contact with the food product, the surface being free from openings.

* * * * *